US009101803B2

(12) United States Patent
Battaglino

(10) Patent No.: US 9,101,803 B2
(45) Date of Patent: Aug. 11, 2015

(54) BAT EXERCISE, PRACTICE, AND TRAINING DEVICE

(76) Inventor: Robert Battaglino, Mesa, AZ (US)

( * ) Notice: Subject to any disclaimer, the term of this patent is extended or adjusted under 35 U.S.C. 154(b) by 1654 days.

(21) Appl. No.: 11/942,541

(22) Filed: Nov. 19, 2007

(65) Prior Publication Data

US 2008/0064536 A1 Mar. 13, 2008

Related U.S. Application Data

(62) Division of application No. 11/012,023, filed on Dec. 13, 2004, now Pat. No. 7,297,077.

(60) Provisional application No. 60/529,054, filed on Dec. 12, 2003.

(51) Int. Cl.
*A63B 69/00* (2006.01)
*A63B 59/00* (2015.01)

(52) U.S. Cl.
CPC ..... *A63B 59/00* (2013.01); *A63B 69/0002* (2013.01); *A63B 2059/0085* (2013.01); *Y10T 29/49826* (2015.01)

(58) Field of Classification Search
USPC ..... 473/422, 437, 457, 526, 564–568, 232, 473/316, 231
See application file for complete search history.

(56) References Cited

U.S. PATENT DOCUMENTS 537,927 A 4/1895 Kennedy
875,273 A 12/1907 Kimble
2,772,887 A 12/1956 Blake
3,116,926 A 1/1964 Owen et al.
3,136,546 A 6/1964 Connolly
3,246,894 A 4/1966 Salisbury
3,414,260 A 12/1968 Gust
3,561,272 A 2/1971 Davis
3,679,205 A * 7/1972 Finkle et al. ..... 473/463
3,880,423 A 4/1975 Kreag
3,955,816 A 5/1976 Bratt
4,225,133 A 9/1980 Kiray
4,267,793 A 5/1981 Lane et al.
D259,501 S 6/1981 Salisbury
4,317,567 A 3/1982 Blake
4,378,113 A 3/1983 Piccini
4,399,996 A 8/1983 Boyce
D274,171 S 6/1984 Gabrielidis
4,511,139 A * 4/1985 Armstrong ..... 473/457
4,555,111 A 11/1985 Alvarez
4,634,121 A 1/1987 Sasaki
4,671,508 A 6/1987 Tetreault
4,763,899 A 8/1988 Hundley
4,819,935 A 4/1989 Dirksing et al.
4,846,472 A 7/1989 Terza
4,854,585 A * 8/1989 Koch et al. ..... 473/232
4,951,948 A 8/1990 Peng
5,215,307 A 6/1993 Huffman
D339,621 S 9/1993 Briden (Continued)

*Primary Examiner* — Mitra Aryanpour
(74) *Attorney, Agent, or Firm* — Schmeiser, Olsen & Watts LLP

(57) ABSTRACT

An exercise, practice, and training device has a transition piece adjustably connected to a distal end of a handle. An action receiving element is bendably connected to a distal portion of the transition piece and extends distally therefrom. The action receiving element is also connected to the transition piece by a biasing element that biases the action receiving element into alignment with the transition piece and enables bending during exercise, practice, and training by the user.

11 Claims, 8 Drawing Sheets

(56) References Cited

U.S. PATENT DOCUMENTS

| | | | | |
|---|---|---|---|---|
| 5,277,421 | A | 1/1994 | Rewolinski | |
| 5,360,209 | A | 11/1994 | Mollica | |
| 5,405,138 | A | 4/1995 | Duran | |
| 5,492,321 | A | 2/1996 | Cipriano | |
| 5,516,097 | A | 5/1996 | Huddleston | |
| 5,599,021 | A | 2/1997 | Lary et al. | |
| 5,674,138 | A | 10/1997 | Nolan | |
| 5,711,728 | A | 1/1998 | Marcelo | |
| 5,741,193 | A | 4/1998 | Nolan | |
| 5,833,561 | A | 11/1998 | Kennedy et al. | |
| D404,097 | S | 1/1999 | Tyner | |
| 5,897,469 | A | 4/1999 | Yalch | |
| 6,022,282 | A | 2/2000 | Kennedy et al. | |
| D445,868 | S | 7/2001 | Fischer | |
| 6,257,992 | B1 | 7/2001 | LeBlanc | |
| D461,213 | S | 8/2002 | Smith | |
| 6,461,163 | B1 | 10/2002 | Gallagher et al. | |
| 6,569,042 | B2 | 5/2003 | LaChance et al. | |
| 7,235,024 | B2 * | 6/2007 | Lefebvre et al. | 473/457 |
| 2001/0034275 | A1 | 10/2001 | Dunnack et al. | |
| 2001/0034276 | A1 | 10/2001 | Brown | |
| 2002/0055402 | A1 | 5/2002 | Ciesar et al. | |
| 2002/0082126 | A1 | 6/2002 | Brundage | |
| 2002/0193187 | A1 | 12/2002 | Bickel et al. | |
| 2003/0013563 | A1 | 1/2003 | Ryan | |
| 2003/0114257 | A1 | 6/2003 | Mabry | |
| 2003/0144089 | A1 | 7/2003 | Ryan | |
| 2004/0162167 | A1 * | 8/2004 | Stevens et al. | 473/457 |

* cited by examiner

BAT EXERCISE, PRACTICE, AND TRAINING DEVICE

CROSS-REFERENCE TO RELATED APPLICATIONS

This patent application claims priority of U.S. Pat. No. 7,297,077 filed on Dec. 13, 2004, which claims priority to U.S. provisional patent application Ser. No. 60/529,054, filed Dec. 12, 2003, the contents of both of which are incorporated herein by reference.

BACKGROUND OF THE INVENTION

1. Technical Field

This invention generally relates to a exercise, practice, and training device, and particularly to a bat exercise device that can be used for practice and training that can be used to improve bat swinging and hitting skills.

2. State of the Art

Several devices have been devised for a variety of purposes including bat adjustability, increased hitting force, providing an audible sound during bat swinging, and other functions. However, the bat devices of the past appear to be deficient in providing a bat device that has a range of adjustability in bending of the bat for the purpose of exercise, practice, and training. The bat devices of the past appear to focus on a relatively narrow aspect of swinging or hitting, and are deficient in providing a practice device that adequately enables the method of the present invention.

DISCLOSURE OF THE INVENTION

The present invention overcomes these deficiencies and provides an exercise, practice, and training device that allows a more robust practice and training. For example, the bat device of the present invention has a range of adjustability in bending of the bat so that a user may selectively adjust the device to suit his or her needs. The adjustment may depend on a frequency of repeated actuations or swings. The user may also adjust the training device based on the swing weight of a non practice bat or other instrument, which he or she is preparing to use.

An exercise, practice, and training device in accordance with the present invention may have a handle for grasping by a user. A transition piece may be adjustably connected to the handle and extend distally therefrom. An action receiving element may be bendably connected to a distal portion of the transition piece and extend distally therefrom. The action receiving element may further be connected to the transition piece by at least one biasing element that generally biases the action receiving element into alignment with the transition piece yet that enables bending during exercise, practice, and training by the user. In one aspect, the exercise, practice, and training device is a bat device that has a range of adjustability in bending so that a user may selectively adjust the device to suit his or her needs. The device may also include a weight position adjustment mechanism and a handle length adjustment mechanism. Adjustments may be made depending on a frequency of repeated actuations or swings. The user may also adjust the training device based on a desired swing weight.

In one aspect, the present invention relates to a bat exercise device. In a simple form, the bat exercise device of the present invention may include a handle having a knob at a proximal end of the handle. The handle may be adjustably connected to a transition piece. The transition piece may be pivotally connected to a barrel piece. A butt end of the device may be connected to a distal end of the barrel piece. The transition piece may also be connected to the barrel piece by at least one biasing element that urges the handle, the transition piece, and the barrel into generally longitudinally aligned orientations relative to each other. The at least one biasing element may include a plurality of tension/compression adjustable springs connected to the transition piece and to the barrel piece.

In another aspect, the present invention includes a method of teaching proper form, rhythm, and accuracy in using an instrument. The method may include the step of adjusting a spring tension of a spring connecting a transition piece to an action receiving element in a practice instrument. The method also may include repeatedly actuating the practice instrument by repeatedly bending the action receiving element relative to the transition piece. Use and repetition aid in an additional step of memorizing a feel associated with actuation of the practice instrument.

By repeatedly swinging the practice instrument user may create mind muscle memory (MMM), especially through high repetitions. For example, repetitions may be implemented in a range from approximately one repetition per one and a half second to approximately eight repetitions per second. Another narrower range of repetitions per second may be from approximately one repetition to approximately six repetitions per second. Although the frequency of repetitions may depend on the characteristics of the biasing element and the location of the center of gravity of the instrument and its components, a user may control the frequency of strokes as desired. A user may repeatedly and rhythmically swing the instrument to an ideal or "the ultimate" striking position. The user may stop the instrument at that point. Doing so causes a deceleration and forces corresponding to the magnitude of deceleration. Due to the bendability of the instrument, the distal end of the instrument moves by a whipping action into a flexed state. The user's mind and muscles experience the associated forces during this action. Exceedingly high forces can be generated by this action and high repetitions may be implemented both of which advantageously aid in development of the user's mind muscle memory. During this action the user experiences a unique whip feel. At the same time, the resistance that a user applies in order to stop the instrument at the ultimate striking position may result in transmission of the sensation of the resultant forces to the user's mind muscle memory. Stopping the instrument at the ultimate striking position works and strengthens the muscles in a first direction. Furthermore, by repeated swinging and returning the instrument to an initial position before a swing, the user may create the mind muscle memory and a unique balance of whip strength, fluidity, speed, timing and rhythm. By repeatedly returning the instrument from the ultimate striking position to an initial position, the muscles may be strengthened in a second opposite direction to provide greater muscle balance and integrity. By developing the mind muscle memory in this way a unique kind of muscle fiber and nerve response may be created, which is more balanced and has a more stable physical structure.

Using a bat swing practice instrument, for example, may be used to strengthen and build a user's forearm muscles to an exceedingly great strength. However, using the instrument also may be used to develop the mind muscle memory of the user to provide proper firing sequences in the muscle systems throughout the body from the feet, up through the legs, hips, torso, shoulders, and arms. Thus, the instrument may be used to facilitate blending or bonding of correct form, balance, timing, rhythm, correct firing sequence, whip strength, fluid muscle action, ultimate strike position location, and accuracy into one homogenized mind muscle memory so that an excellent swing becomes simple and natural. As can be appreciated, repetitions and high repetitions are advantageous in this process. It is to be understood that such mind muscle memory and strengthening may be applied to other instruments and actions in a variety of athletic and other applications.

The step of repeatedly actuating the practice instrument may further include practicing proper balance and mechanical form at selected frequencies of repetitions and developing control that may be applied to a non practice instrument. Furthermore, the step of repeatedly actuating the practice instrument may include building up quick twitch macro and micro muscle control and teaching a user's body a proper firing sequence for actuation.

The step of adjusting the spring tension may include adjusting a resistance to bending of the action receiving element relative to the transition piece. The bat exercise device may include a weight adjustably mounted on the barrel piece for selective longitudinal positioning of the weight along the barrel piece. With a device including an adjustable weight, the method may include adjusting a position of a weight along a length of the action receiving element to simulate a particular non practice instrument. Alternatively, the device and method may include adjusting the size of the weight in addition or in place of adjusting its position. Additionally, the method may include adjusting a position of the handle relative to the transition piece to simulate a particular non practice instrument.

In an even more general aspect, the bat exercise device need not be configured to necessarily define the customary elements of a bat, such as a knob and/or transition piece. Rather, the bat exercise device of the present invention may simply be a device that is movable between a quiescent state and a flexed state and having a handle, a barrel piece, and a tension adjustable biasing element connecting the handle and the barrel piece that tends to maintain the handle and the barrel piece generally in the quiescent state. In this case, a tension varying force is necessary to transition from the quiescent state to a flexed state. This force may be provided by swinging the bat exercise device.

It is to be understood that the tension adjustable biasing element may comprise a single tension adjustable spring connected to the handle and to the barrel piece. Alternatively, the tension adjustable spring may be one of a plurality of tension adjustable springs and the biasing element may include the plurality of tension adjustable springs connected to the handle to the barrel piece.

In this aspect, a weight may be mounted on the barrel piece. The weight may be adjustably mounted on the barrel piece for selective and advantageous longitudinal positioning of the weight along the barrel piece. The weight possibilities set forth with regard to other aspects above may be applied equally well to this simplified aspect of the invention.

Additionally, the adjustable biasing element may provide an adjustable resistance to bending from the quiescent state to the flexed state in a range from approximately one half foot pound to approximately 500 foot pounds of torque. Alternatively, the adjustable resistance may be kept to a narrower range from approximately one half foot pound to approximately 20 foot pounds of torque. These ranges may be for the initial force required to begin moving the instrument into the flexed state. This initial force corresponds to the initial deflection of the spring from its position when the instrument is in its quiescent state. Springs typically require more force as they are further deflected. Thus, the forces present in and required for further deflection once in the flexed state may be much greater than those of the ranges set forth above. These forces are dependent, in part, on the spring characteristics of the particular springs of the instrument.

In this aspect, the handle may be a length adjustable handle for enabling a user to selectively adjust a length of the handle. With regard to the handle and all other elements of the invention in this simplified aspect, the above described method may be applied. In this regard, the transition piece may be considered to be part of the handle so that the steps of the method may be carried out by applying a swinging force to the handle, which actuates the biasing element and flexes the barrel piece relative to the handle.

In a simple form, the method of teaching proper form, rhythm, and accuracy in using an instrument may include the step of adjusting a torque requirement for moving a first portion of the instrument from a quiescent state to a flexed state relative to a second portion thereof. The method may further include repeatedly actuating the practice instrument by repeatedly flexing the second portion relative to the first portion. The step of adjusting the torque requirement may be achieved by adjusting a resistance to bending in a third portion of the instrument between the first portion and the second portion.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
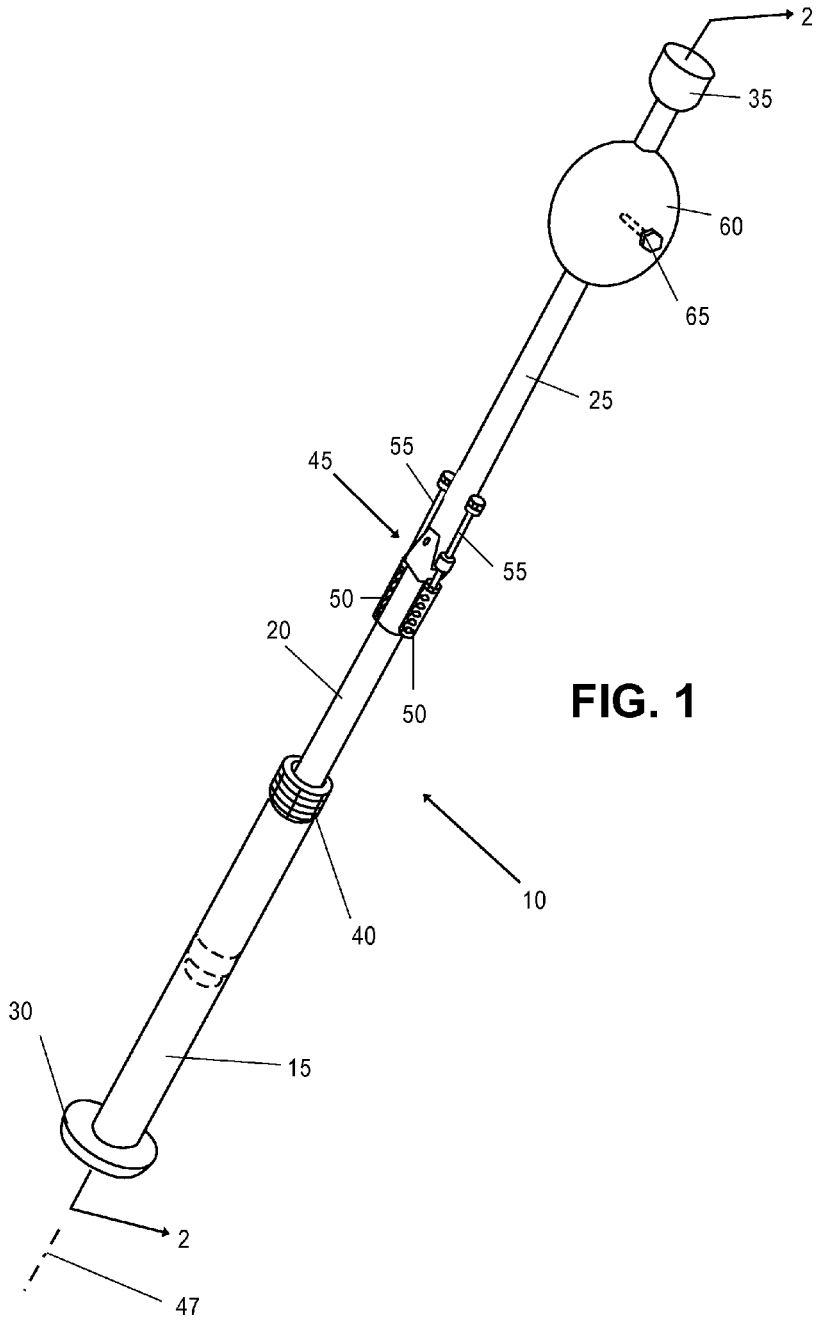
FIG. 1 is a perspective view of a bat exercise, practice, and training device in accordance with one embodiment of the present invention.

As discussed above, embodiments of the present invention relate to bat exercise, practice, and training device. In accordance with an example of the present invention, FIG. 1 is a perspective view of a bat device 10 having a handle 15, a transition piece 20, and a barrel piece 25. The handle has a knob 30 fixed at a proximal end thereof, and the barrel piece 25 has a butt end 35 at a distal end thereof. The transition piece 20 connects the handle 15 to the barrel piece 25. Thus, the bat device 10 has a handle 15, transition piece 20, and barrel piece 25 corresponding to those elements found on a conventional bat. Therefore, the bat device 10 may be grasped and swung as an exercise, practice, and/or training device.

The handle 15 is adjustably mounted on the transition piece 20 by a handle nut 40. In order to adjust the handle, a user loosens the nut 40 and slides the handle 15 axially relative to the transition piece 20. Then the user tightens the handle nut 40 to secure the handle 15 relative to the transition piece 20. As may be appreciated, a distal end of the handle 15 may have slots. These slots may be surrounded by the handle nut 40 in order to enable the material at the distal end of the handle 15 to be resiliently collapsed to engage the transition piece 20 when the handle nut 40 is tightened. This tightening may be accomplished by threads on the interior of the handle nut 40 and on the exterior of the handle 15, which engage each other during tightening and loosening of the nut 40 on the handle 15. Alternatively, spring biased pins or detents may be provided on one of the handle 15 and the transition piece 20, and apertures or receivers may be provided on the other of the handle 15 and the transition piece in order to receive the pins or detents and provide a locking mechanism that holds the handle 15 in one of a plurality of discrete positions relative to the transition piece 20.

The transition piece 20 is pivotally or bendably connected to the barrel piece 25 by a bending or pivot connection 45. The barrel piece 25 is held in a generally aligned position relative to a longitudinal axis 47 of the handle and the transition piece 20 by a pair of biasing elements 50. In FIG. 1, the biasing elements 50 are shown as a pair of helical compression springs. However, it is to be understood that the biasing elements may be provided by any of a variety of compression, tension, or torsion springs. For example, the biasing elements 50 could be replaced by one or more polymeric material elements. The springs could be provided by one or more helical tension springs. As shown in FIG. 1, the present invention may include adjustment bolts 55 operably associated with the compression springs 50. In the embodiment shown in FIG. 1, the adjustment bolts 55 may be tightened or loosened in order to adjust the amount of tension or compressive force is stored in the springs 50. It is to be understood that the term tension as used herein refers generally to tension, compression, or torsional forces of springs that have been moved out of their quiescent state of minimum potential energy. By adjusting the tension in the springs 50, a resistance to bending or pivotal movement of the barrel 25 out of alignment with the longitudinal axis 47 may be adjusted. That is, as the stiffness in the springs 50 is increased, the resistance against movement out of alignment with the longitudinal axis 47 is increased.

A weight 60 may be adjustably mounted on the barrel piece 25. In the embodiment shown in FIG. 1, the weight 60 is slidably mounted on the barrel piece 25. A weight bolt 65 may extend through the weight and hold the weight at a selected longitudinal position on the barrel piece 25. In this way, a user may selectively adjust the swing weight of the bat device. Generally, the swing weight is increased as the weight 60 is moved distally along the barrel piece 25. As may be appreciated, a greater swing weight will tend to cause a greater reaction in the biasing elements 50 during swinging. Thus, a desired response in the device 10 may be achieved by adjusting both the tension in the biasing elements 50 and the position of the weight 60 along the barrel piece 25.

Adjustment of the biasing elements 50 provides a resistence to bending in a range that is useful for exercise, practice, and training with the device 10 of the present invention. The biasing elements 50 may be adjustable to provide resistance in a full range from approximately ½ foot pound of torque to approximately 200 foot pounds of torque about a pivot point of the pivot connection 45. For the bat device 10 of FIG. 1, the resistance may be adjusted in a smaller range from approximately ½ foot pound to approximately 20 foot pounds of torque about the pivot axis of the pivot connection 45. A range from ¼ foot pound to approximately 500 foot pounds is also within the spirit and scope of the present invention. It is to be understood that the resistance referred to herein is an initial resistance when the bat device 10 is in a quiescent state with the handle 15 and the barrel piece 25 in generally longitudinally aligned positions relative to each other. It is further to be understood that as the barrel piece 25 is moved out of alignment relative to the handle 15, the resistance will generally grow progressively greater as the biasing elements 50 are tensioned to a greater degree. By pretensioning the biasing elements 50, the progression of resistance may be selectively adjusted. Alternatively or additionally, a variety of interchangeable biasing element having a variety of spring characteristics may be provided for selectively replacing the biasing elements 50. It is to be understood that one of the biasing elements 50 may be pretensioned to a greater or lesser degree or may be replaced so that the barrel piece may be moved out of the quiescent state more easily in one direction than the other. This configuration could be effectuated in order to advantageously work and strengthen a targeted set of muscles in a user. To do this may be desirable when the user needs to strengthen the muscles that move the bat device 10 in one direction more than he/she needs to strengthen the muscles that move the bat device in the other direction along a swing path, for example.

Other devices or practice instruments may be provided with similar biasing mechanisms. Depending on a particular application of the practice instrument, the range of resistence may be selectively chosen. For example, with an instrument configured to practice a tennis swing, a range of smaller torque resistances may be provided. On the other hand, a biasing mechanism in accordance with the present invention as applied to a bow practice instrument may be provided with torque resistances in a range including higher values of torque. Other applications for the biasing mechanism of the present invention may include golf and hockey practice instruments. The adjustability of the handle relative to a transition piece and/or the adjustability of a weight may be applied similarly to any of the applications in which the present invention may be implemented.

Figure 2:
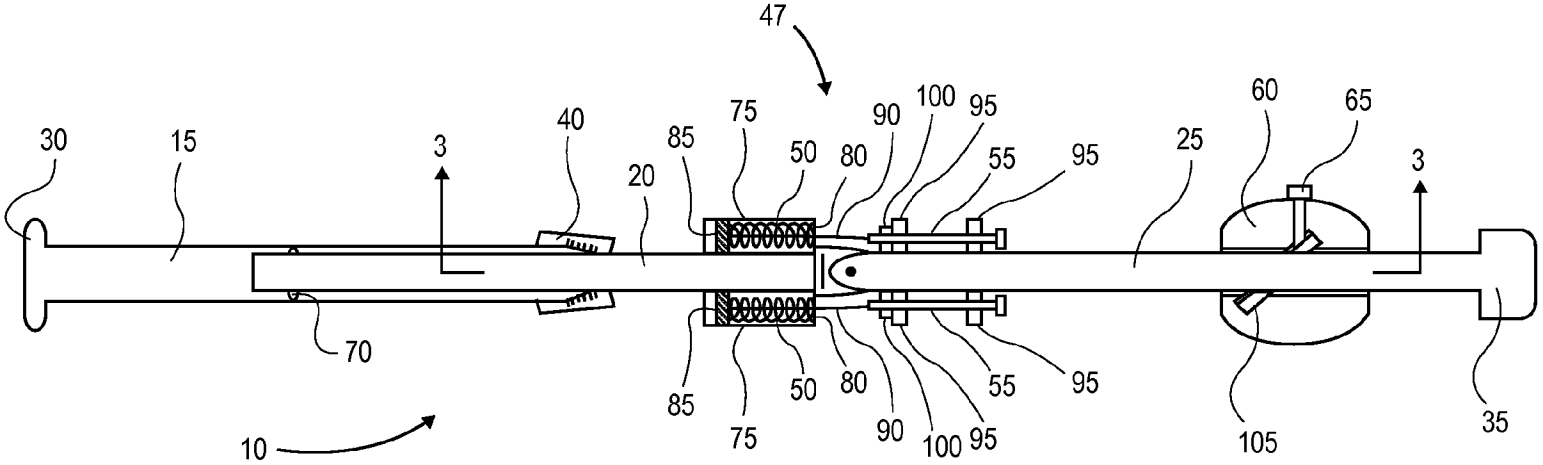
FIG. 2 is a sectional view taken along lines 2-2 of FIG. 1.

FIG. 2 is a sectional view taken along line 2-2 of FIG. 1. FIG. 2 shows some features of the bat device in greater detail. For example, a telescoping relationship between the handle 15 and the transition piece 20 is clearly shown in FIG. 2. At a distal end of the handle 15, the handle nut 40 may force portions of the handle 15 radially inward to engage the transition piece 20 when the nut 40 is tighten. At a proximal end of the transition piece 20 a spacer 70 may be provided to take up slack between an inner dimension of the handle 15 and an outer dimension of the transition piece 20. As may be appreciated, by loosening the nut 40 the handle 15 may be slidably adjusted along the transition piece 20 in a longitudinal direction. Then the handle 15 may be tightened in a desired relative position.

FIG. 2 also shows the biasing elements 50 and housings 75 in which the biasing elements are retained in greater detail. A distal end of each of the housings 75 provides a fixed stop 80 for each of the biasing elements 50. Respective washers or other plug elements positioned generally toward a proximal end of the housings 75 form respective adjustable spring stops 85. Respective cables 90 may be fixed to the adjustable spring stops 85 at a proximal end of the cables 90 and fixed to respective adjustment bolts 55 at distal ends of the cables 90. The adjustment bolts 55 may be mounted on the barrel piece 25 by guide studs 95. The adjustment bolts 55 may be moved axially relative to the guide studs 95. However, threaded studs 100 may be fixed either to the guide studs 95 or directly to the barrel piece 25. Thus, adjustment of the guide bolts 55 relative to the threaded studs 100 and the barrel piece 25 may be implemented to cause adjustment of the cable 90 and the adjustable spring stops 85. In this way, the housings 75 may act as cylindrical spring housings. The stops 80 at distal end of the housings may act as fixed spring stops and the adjustable spring stops 85 may be moved axially within the spring housings 75 to provide a desired compression in the springs 50. As shown in FIG. 2, movement of the adjustment bolts 55 in a distal direction causes compression of the biasing elements 50 via the cables 90. Thus, resistance to bending at the pivot connection 47 may be increased or decreased as desired.

Also shown in FIG. 2 is the weight bolt 65 and a weight fixing element 105. As may be appreciated, tightening of the weight bolt 65 may be implemented to cause the weight fixing element 105 to be canted relative to the barrel piece 25. In this canted position, the weight fixing element 105 engages or bites into a surface of the barrel piece and fixes the weight 60 on the barrel piece 25. This fixing may be provided by a friction force or an actual mechanical interference between the weight fixing element 105 and the barrel piece 25.

Figure 3:
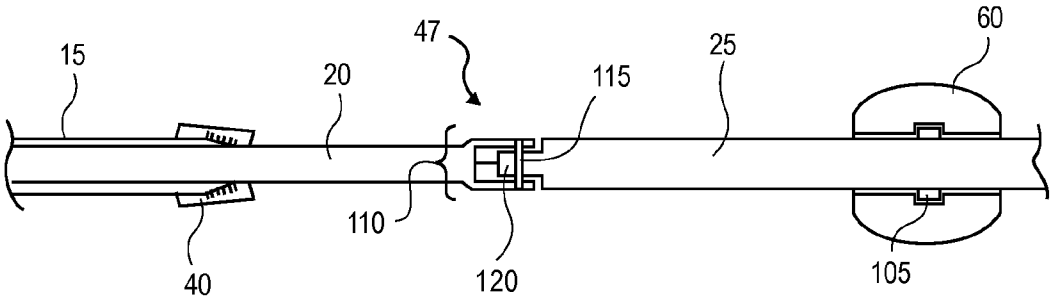
FIG. 3 is a sectional view taken along lines 3-3 of a portion of FIG. 2.

FIG. 3 is a sectional view of the bat device 10 taken along lines 3-3 of a portion of FIG. 2. FIG. 3 shows the pivot connection 47 in greater detail. In particular, a bracket 110 may be integrally formed with the transition piece. This bracket 110 may have through holes for receiving a pin 115. A nose piece 120 may be integrally formed with the barrel piece 25. The nose piece 120 may also have a through hole pivotally engaged by the pin 115. As may be appreciated, the positions of the bracket 110 and the nose piece 120 may be interchanged without departing from the spirit and scope of the present invention. Furthermore, the pivot connection may be located more proximally for a different feel in the practice instrument during use.

Figure 4A:
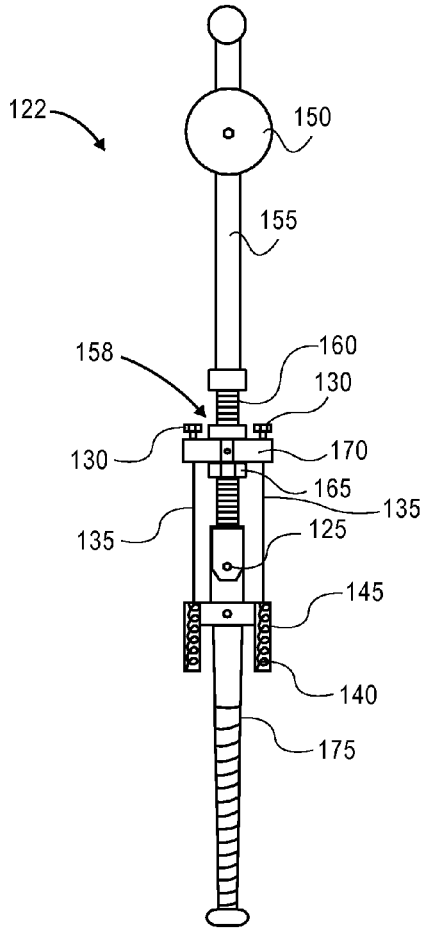
FIGS. 4A-4B are diagrammatic side views of other embodiments showing a variety of mechanisms in respective embodiments that may be used in alternative or additive ways with respect to the other embodiments of the present invention.

FIG. 4A is a diagrammatic side view of another embodiment of a bat device 122 in accordance with the present invention. A pivot connection may be provided by a pin 125. Adjustment bolts 130, cables 135, biasing elements 140, and housings 145 may be provided as shown to function similarly to analogous elements shown in the embodiment of FIGS. 1-3. Similarly, a weight 150 may be adjustably mounted on the barrel piece 155. The barrel piece may include a general tension adjustment mechanism 158, shown in FIG. 4A as including a threaded portion 160. An adjustable collar 165 may be adjustably supported on the threaded portion 160. The collar 165 may support a bracket 170 that in turn supports distal ends of the cables 135 on the barrel piece 155. Thus, the general adjustment mechanism 158 permits adjustment of both cables 135 simultaneously, while the adjustment bolts 130 enable selective adjustment of the cables 135 individually. It is to be understood that a handle 175 may be a non-adjustable handle as shown in FIG. 4A, or it may be provided as an adjustable handle as shown in the embodiment of FIGS. 1-3.

Figure 4B:
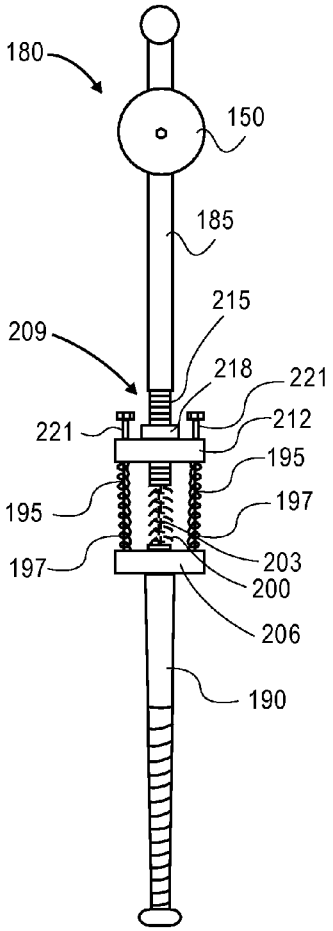

FIG. 4B is a diagrammatic side view of another embodiment of a bat device 180 in accordance with the present invention. Like the previously described embodiments, the bat device 180 may include a weight 150 that is adjustable along a barrel piece 185 and a handle 190. The handle 190 may be connected to the barrel piece 185 by a plurality of biasing elements 195 and cables 197. As shown, the biasing elements may be disposed on opposite sides of a central longitudinal axis of the device 180, and may comprise two or more biasing elements 195 generally spaced around the central axis. An additional biasing element 200 and an additional cable 203 may be centered on the central longitudinal axis. Notably, there may be no discrete pivot axis provided by the connection of the handle 190 to the barrel piece 185 in the embodiment shown in FIG. 4B. Rather, the biasing elements 195, 200 and the cables 197, 203 may be provide the only connection as a flexible connection that will bend about a constructive pivot axis that is a function of the spring characteristics of the biasing elements 195 and/or 200, the placement and orientation of the biasing elements 195 and/or 200, and the structure that holds the biasing elements to the barrel piece 185 and the handle 190.

As shown, a handle bracket 206 may have seats for receiving proximal ends of the biasing elements 195 and/or 200. The device 180 may include a general adjustment mechanism 209 similar to that shown and described with regard to the embodiment of FIG. 4A. An adjustable bracket 212 may be adjustably supported on a threaded portion 215 of the barrel 185 by a collar 218 similar to the embodiment of FIG. 4A described above. The adjustable bracket 212 may have seats for receiving distal ends of the biasing elements 195 and/or 200. When the bat device 180 does not have a discrete pivot axis, provided by a pivot pin for example, adjustment of the collar 218 and adjustable bracket 212 along the threaded portion 215 will result in moving the barrel piece 185 along the longitudinal axis in a lengthening or shortening direction. When the additional biasing element 200 is included, adjustment of the adjustable bracket 212 will also adjust a tension in the additional biasing element 200, which will cause a more or less stiff response to bending. Similar to the embodiment of FIG. 4A, the bat device of FIG. 4B may include adjustment bolts 221 connected to distal ends of the cables 197 for individual adjustment of the biasing elements 195. Thus, the adjustable bracket 212 may have internal threads that receive the adjustment bolts 221.

Figure 4C:
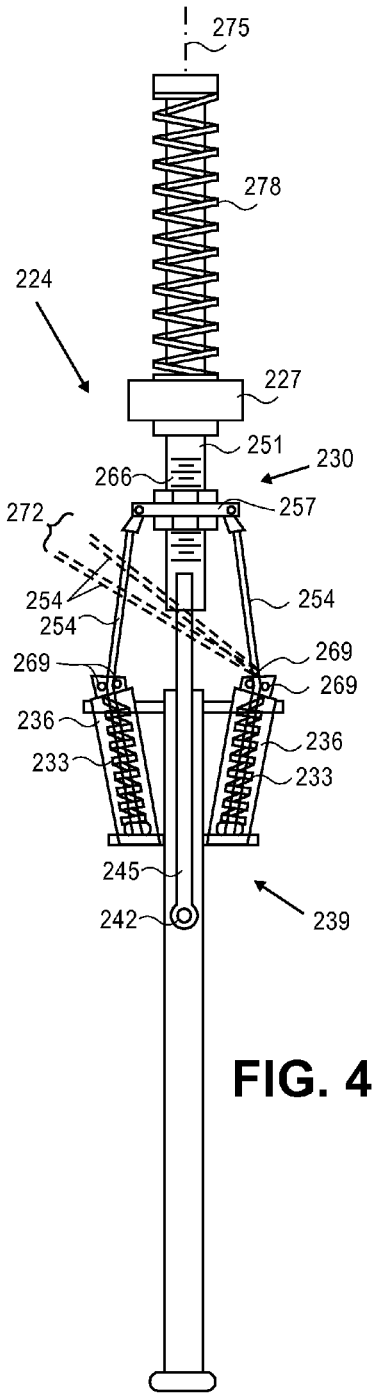
FIGS. 4C-4D are diagrammatic side and front views of another embodiment showing a variety of mechanisms in respective embodiments that may be used in alternative or additive ways with respect to the other embodiments of the present invention.
Figure 4D:
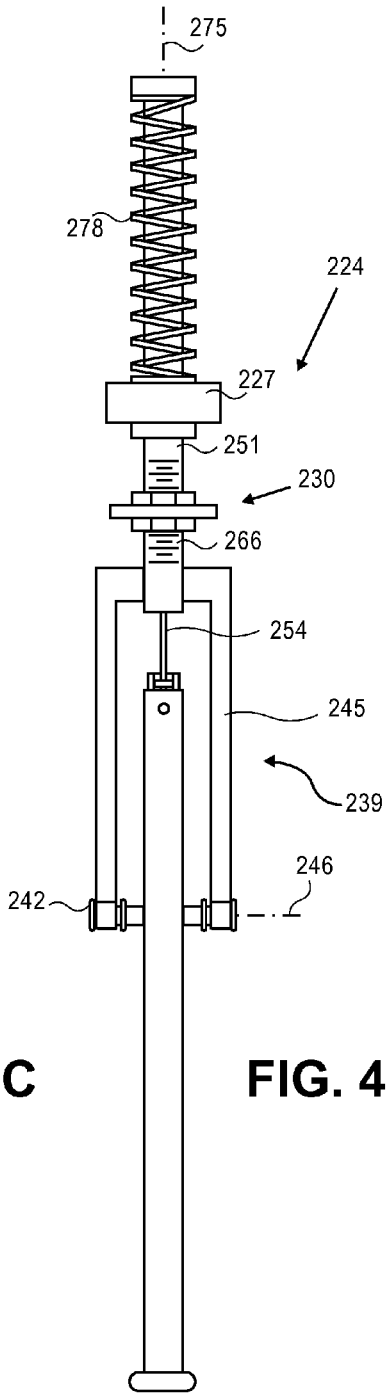

FIGS. 4C-4D show another embodiment of a bat device 224 in accordance with the present invention. FIG. 4C is a first diagrammatic side view of the bat device 224 and shows a weight 227, an adjustment mechanism 230, biasing elements 233 in housings 236 similar to features shown and described in the embodiments shown in FIGS. 1-4B above. The device 224 has a pivot mechanism 239 having pivot pins 242 and pivot arms 245 pivotally mounted on the pivot pins 239 and defining a pivot axis 246, as shown in FIGS. 4C and 4D. FIG. 4D is a front diagrammatic view of the device of FIG. 4D. The pivot mechanism 239, and the pivot arms 245 in particular, connect a handle 248 to a barrel piece 251. The pivot arms 245 are much longer than analogous parts of the bat device 10 of FIGS. 1-3. The longer arms 245 and the more proximally located pivot pins 242 of the embodiment of FIGS. 4C and 4D have the advantage of enabling a larger range of motion for the barrel piece during use. Relatedly, the mechanical advantage is shifted toward the distal end so that the barrel piece 251 and the associated weight have a much greater influence on the motion during back and forth movement than when a pivot axis is more distally located. The distal ends of the pivot arms 245 may be fixed to the barrel piece 251 to move therewith during use.

As with the previously described embodiments, cables 254 are connected at distal ends thereof to an adjustable bracket 257 of the adjustment mechanism 230 and to adjustable stops 260 at proximal ends thereof to help control the movement of the device. As described with regard to the embodiments shown in FIGS. 4A and 4B, the device 224 has an adjustment collar 263 that adjustably supports the adjustable bracket on a threaded portion 266 of the barrel piece 251 for threadedly adjusting a position of the adjustable bracket 257 along the barrel piece 251. This adjustment is a general adjustment that affects both of the biasing elements 233 at the same time. A specific adjustment mechanism may be separately applied to each of the cables 254 for selective adjustment of each of the cables 254 and associated biasing elements 233. As shown in FIG. 4A, rollers or other friction reducing elements may be provided at distal ends of the housings 236 on opposite sides of the cables 254 to reduce friction on the cables 254 as the barrel piece 251 is moved back and forth. As may be appreciated, the forward cable 254, forward housing 236, and associated connections have been omitted in FIG. 4B for clarity. As shown in dashed lines at 272 in FIG. 4A, the cable 254 may be moved to a greater or lesser degree corresponding to a particular range of motion of the barrel piece 251 during a particular use. Furthermore, the housings 236 may be angled to a greater or lesser degree to provide a variety of "feels" that may be suited to a particular user and/or exercise. In this regard, the housings may lie at an angle in a range from zero to thirty degrees relative to a central longitudinal axis 275. A more narrow range of angles at which the housings 236 may lie may be from ten to twenty degrees relative to the central longitudinal axis 275. The housings could be made adjustable so that a user can selectively move the housings to desired positions and lock them therein by a detent or other locking mechanism.

The bat device 224 of the embodiment of FIGS. 4C and 4D may also include a resilient weight biasing element 278 that urges the weight 227 into a quiescent weight position on the barrel piece 251. However, when the bat device is swung, the weight 227 will dynamically move distally and/or proximally. The weight controlled by the weight biasing element 278 moves to increase or decrease a swing weight commensurate with a centrifugal force applied to the bat device 224. This arrangement may be applied to any of the embodiments herein and may have the advantage of increasing the force required to effectively move the bat back and forth commensurate with the speed of the swing.

Figure 5:
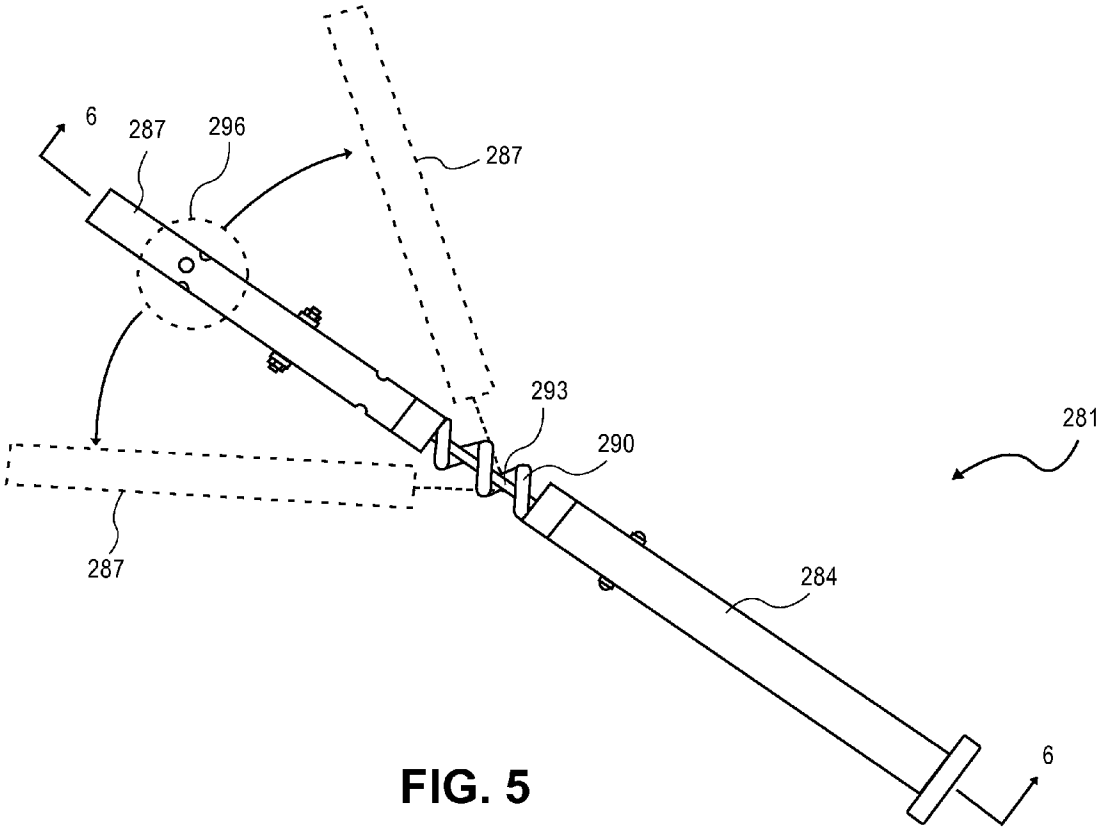
FIG. 5 is a side view of a bat exercise, practice, and training device in accordance with another embodiment of the present invention.

FIG. 5 is a side view of a bat device 281 in accordance with another embodiment of the present invention. The device 281 has a handle 284, a barrel piece 287, a biasing element 290, and a cable 293 that function generally analogously to the embodiments shown and described above. The bat device 281 is particularly similar to the embodiment shown in FIG. 4B. The biasing element 290 and the cable 293 may connect the barrel piece 287 to the handle 284 and may help to control relative movement between the handle 284 and the barrel piece 287 during use. As with the other embodiments, the bat device 281 may be swung back and forth through a selected portion of a full swing. When a direction of the swing is reversed, the biasing element 290 bends under the force of momentum of the barrel piece 287. The result is that the barrel piece 287 may be moved back and forth through a range of motion relative to the handle 284 as indicated by positions of the barrel piece 287 shown in the dashed lines in FIG. 5. A weight 296 similar to any of those shown and described above may be supported on the barrel piece to adjustably or variably provide different swing weights.

Figure 6:
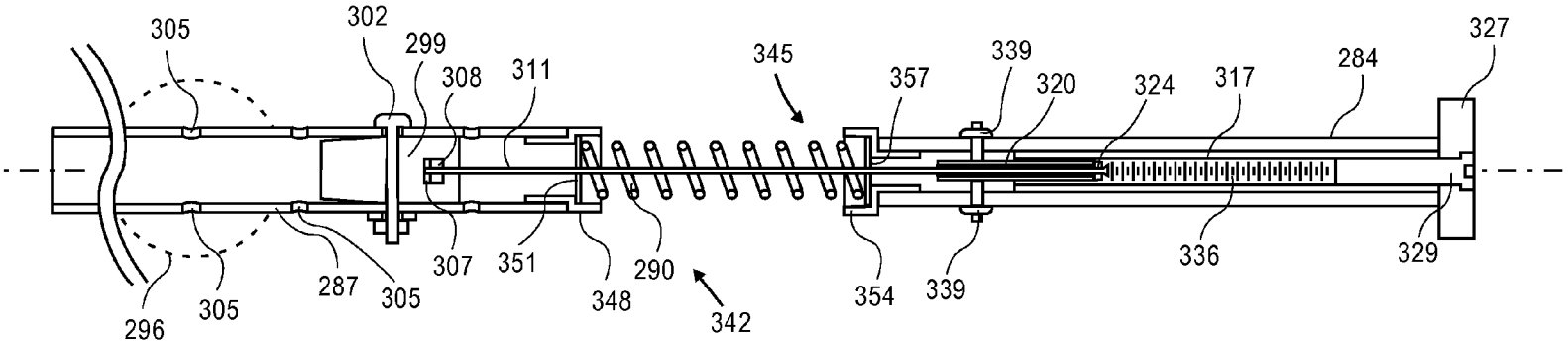
FIG. 6 is a sectional view taken along lines 6-6 of FIG. 5.
Figure 8:
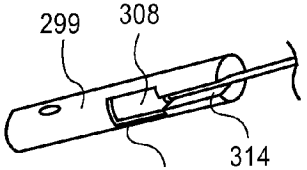
FIG. 8 is a detailed perspective view of another portion of the device of FIG. 5.

FIG. 6 is a sectional view taken along lines 6-6 of FIG. 5 showing additional details. For example, a distal end of the cable may be anchored in the barrel piece 287 by a retaining block 299 that may be slidably received and secured inside the barrel piece 287 by an anchor bolt 302. As shown, a variety of pairs of bolt holes through the barrel piece may enable selective positioning of the retaining block 299. The securing block may have a reentrant recess 307 for receiving a cable nut or other stop element 308 fixed to a distal end of the cable 293. The retaining block 299 with its reentrant structure and the stop element 308 may form a positive stop that prevents movement of the cable in a proximal direction when the stop element 308 is in the recess 307. The retaining block may also include a slit 314 through which the cable 293 may be slid to easily remove the stop element 308 from the reentrant recess 307 as shown in FIG. 8. However, this slit 314 only opens out through a surface that is unobstructed when the retaining block 299 is removed from the interior of the barrel piece 287. Thus, an anchor structure for a distal end of the cable 293 may be exceedingly secure when the retaining block 299 is bolted in position within the barrel piece 287.

Figure 7:
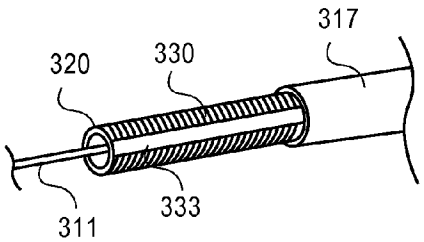
FIG. 7 is a detailed perspective view of a portion of the device of FIG. 5.

As also shown in FIG. 6, a proximal end of the cable 293 may be adjustably secured in the handle 284 by a tension adjustment mechanism 316 having an adjuster sleeve 317 that adjustably engages a retaining sleeve 320. A proximal cable nut or stopping element 324 may be fixed to a proximal end of the cable 293 for positive stopping engagement on a proximal end of the retaining sleeve 320 to secure the proximal end of the cable 293 in the handle at an adjusted position against movement in a distal direction. The retaining sleeve 320 may have external threads 330 and one or more flats 333 on an outer surface thereof, as shown in the detailed perspective view of FIG. 7. The adjuster sleeve 317 may be fixed to a knob 327 by a knob screw 329 or other fixing mechanism. The adjuster sleeve 317 may have internal threads 336 for adjustable engagement by the retaining sleeve 320. One or more holding screws 339 may be received through the handle 284 and lightly engage or be slightly spaced from respective flats 333 on the retaining sleeve 320. In this way, the holding screws 339 may prevent the retaining screw from turning while the knob 327 and the adjuster sleeve 317 are being rotated during adjustment. Thus, the knob 327 may be rotated to cause the retaining sleeve to threadedly advance in proximal or distal directions within the handle 284.

The cable 293 may extend through the biasing element 290 and hold the biasing element against radial movement from between the handle 284 and the barrel piece 287. A first biasing element seat 342 may be received in a proximal end of the barrel piece 287 and a second biasing element seat 345 may be received in a distal end of the handle 284. The first biasing element seat 342 may include a first biasing element sleeve 348 and a first blocking element 351 that rests on a step of the first biasing element sleeve 348. Likewise, the second biasing element seat 345 may include a second biasing element sleeve 354 and a second blocking element 357 that rests on a step of the second biasing element sleeve 354. The biasing element may thus be received at least partially into the respective biasing element sleeves 348 and 354, and held against distal and proximal movement by the blocking members 351 and 357. With the bat device 281 assembled as shown in FIGS. 5 and 6, the user may exercise, practice, and/or train by moving the device 281 back and forth along segments of a full swing path. For a more stiff bending response to swinging, the user may either tighten the assembly by rotating the adjuster sleeve 317 and the knob 327 to draw the retaining sleeve 320 distally and to compress the biasing element 290, replace the biasing element 290 with a stiffer biasing element, or both. Likewise, a more flexible or easily bendable response may be achieved by adjusting the bat device in the opposite direction and/or by replacing the biasing element with a softer biasing element. It is to be understood that one or more bearings may be placed between the adjuster sleeve and the handle to reduce friction for greater ease of adjustment.

Figure 9:
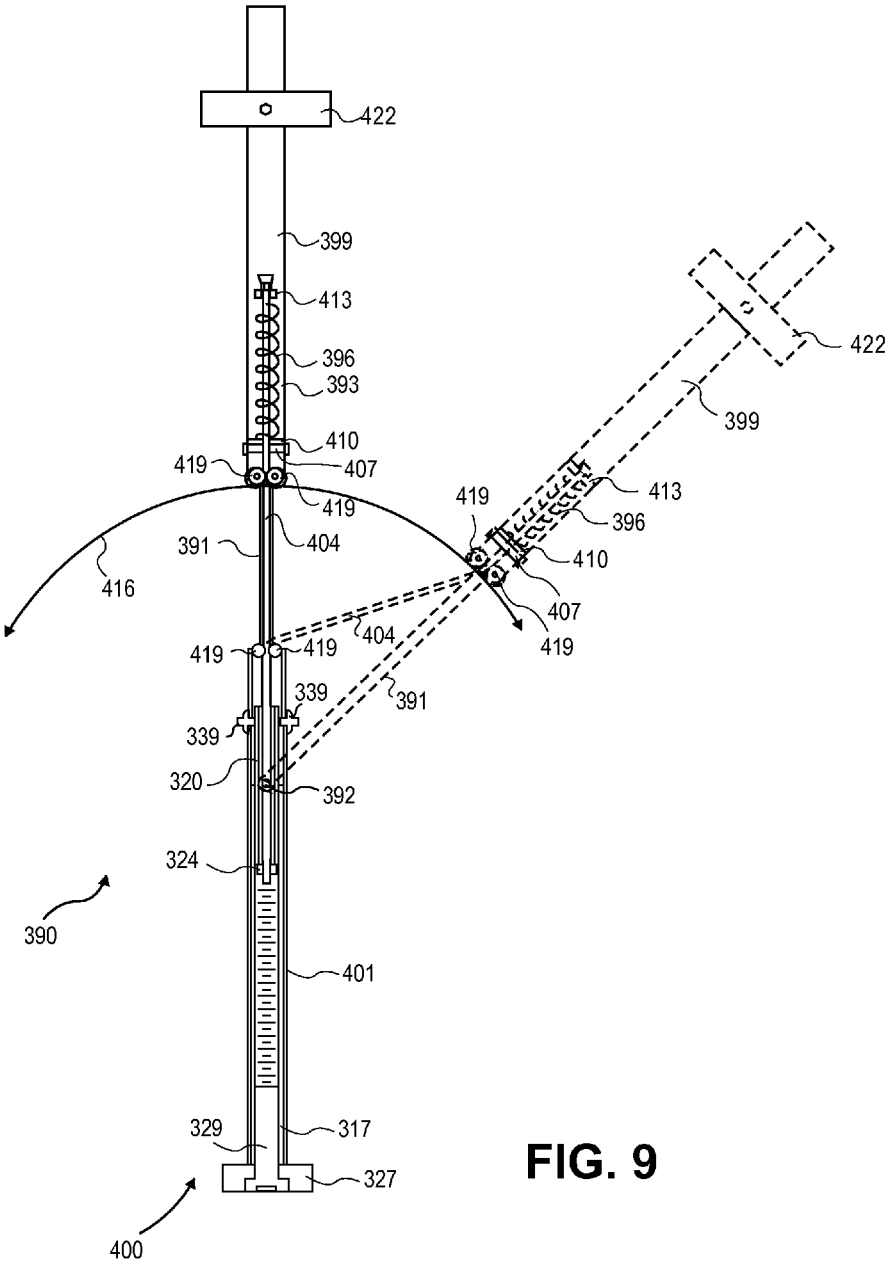
FIG. 9 is a sectional side view of another embodiment of a bat exercise in accordance with the present invention.

FIG. 9 is a side sectional view of another embodiment of a bat device 390 in accordance with the present invention. The side sectional view of the bat device 390 in FIG. 9 is similar to the sectional view of FIG. 4C. The bat device 390 of FIG. 9 may also include pivot arms 391 and a pivot connection 392 similar to the embodiment shown in FIGS. 4C and 4D. Hence, a front view of the bat device 390 showing the pivot arms 391 and pivot connection has been omitted for efficiency. On the other hand, the bat device 390 of FIG. 9 may have a housing 393 for surrounding a biasing element 396. The housing 393 may be provided by a portion of a barrel piece 399. Furthermore, a spring tension adjustment mechanism 400 may be provided in a handle 401 by structure similar to the tension adjustment mechanism 316 shown and described with regard to FIGS. 6 and 7.

In fact, the tension adjustment mechanism 400 may have an adjuster sleeve 317 that adjustably engages a retaining sleeve 320. A proximal cable nut or stopping element 324 may be fixed to a proximal end of a cable 404 for positive stopping engagement on a proximal end of the retaining sleeve 320 to secure the proximal end of the cable 293 in the handle at an adjusted position against movement in a distal direction. The retaining sleeve 320 may have external threads 330 and one or more flats 333 on an outer surface thereof, as shown in the detailed perspective view of FIG. 7. The adjuster sleeve 317 may be fixed to a knob 327 by a knob screw 329 or other fixing mechanism and may have internal threads 336 for adjustable engagement by the retaining sleeve 320. One or more holding screws 339 may be received through the handle 284 and lightly engage or be slightly spaced from respective flats 333 on the retaining sleeve 320. In this way, the holding screws 339 may prevent the retaining screw from turning while the knob 327 and the adjuster sleeve 317 are being rotated during adjustment. Thus, the knob 327 may be rotated to cause the retaining sleeve to threadedly advance in proximal or distal directions within the handle 401.

A positive stop for the biasing element 396 may be positioned within the barrel piece 399 at a proximal end of the biasing element 396 for limiting movement of the biasing element in a proximal direction. The positive stop may include one or more pins 407 and/or a washer element 410 for holding the biasing element 396 in the housing 393. The cable 404 may extend from the stopping element 324 on its proximal end, through the retaining sleeve 320 and a distal portion of the handle 401, out of the handle 401 and into the barrel piece 399, through the positive stop and the biasing element 396 in the housing 393. The cable may be slidably disposed in the positive stop. A distal end of the cable 404 may be retained against a distal end of the biasing element 396 by a distal cable stopping element 413. The pivot connection may be located on the handle at a position proximal to a distal end of the handle 401 at which the cable 404 exits the handle 401. Thus, as the barrel piece 399 and the pivot arms 391 are pivoted relative to the handle 401, tension in the cable 404 is increased, and a distal end of the cable 404 is drawn proximally along the barrel piece against the bias of the biasing element 396. The distal stopping element 413 compresses the biasing element 396 during such bending of the bat device. Rollers 419 or other friction reducing elements may be placed at exit and entry ends of the handle 401 and barrel piece 399 to slidably or rollably engage the cable 404 and provide a smooth action during back and forth movement of the barrel piece 399. As shown by arrow 416, the bat device 390 of FIG. 9 may thus be used in the same way as the other embodiments described herein for smooth resilient back and forth movement during practice, exercise, and/or training. As described above, a weight 422 may be adjustably or resiliently provided on the barrel piece.

As shown and described in U.S. provisional patent application Ser. No. 60/529,054, filed Dec. 12, 2003 and entitled BAT EXERCISE, PRACTICE, AND TRAINING DEVICE the disclosure of which is incorporated herein in its entirety, the various embodiments of the present invention may include any of a variety of mechanisms for creating an audible click at the ultimate striking position. The mechanism may be configured so that when the user decelerates the instrument, the mechanism produces the audible sound. Thus, the user may strengthen the muscles that control the instrument and memorize the position at which a ball will strike the instrument, for example. Therefore, the audible click devices of the present invention may provide an audio sensory system that may help to embed another mind muscle memory into the user. That is, the audible click at the ultimate striking position may be implemented to help the user develop and memorize proper timing, rhythm, and feel.

Also shown and described in the provisional application, the embodiments of the present invention may include slidably or otherwise longitudinally adjustable hinge elements. As may be appreciated, these hinge elements may be slid in channels on the barrel and handle portions of a bat swing practice instrument, for example, to provide for positioning of the hinge with respect to the rest of the instrument. Adjustment of the hinge elements may also be implemented to provide a greater or lesser range of motion for the hinge. This in turn may provide a selectively variable angular feel during repeated forward and rearward motion or whipping of the instrument. Lengthening or shortening the handle/transition and/or barrel piece relative to the pivot axis may effectively increase or decrease resistance of the swing motion. This may be useful, for example, in providing a user with a longer or a shorter swing motion respectively for practicing different swings and different frequencies of back and forth movement of the instrument along the swing path.

Further shown and described in the provisional application to which this application claims priority, cable stabilizers that may extend transverse to the longitudinal axis of the instruments through the pivot points thereof may be applied to any of the embodiments of the present invention. These cable stabilizers help maintain cable line integrity. These stabilizers may be fixedly or rotatably connected to a pivot pins at the pivot axes of the hinges. The stabilizers may help to improve the flex feel that the user experiences. The cable stabilizers may also reduce the change in length of the springs by constraining the path of the cables. This path constraint by the cable stabilizers may also improve angles at which the cables enter the spring cylinders. That is, the entry angle of the cable may be kept straighter, which may provide a smoother feel to the user. Pulleys or other friction reducing elements may be used in the cable stabilizers and/or at other locations to further improve the smoothness with which the cables travel along their respective paths.

Figure 10:
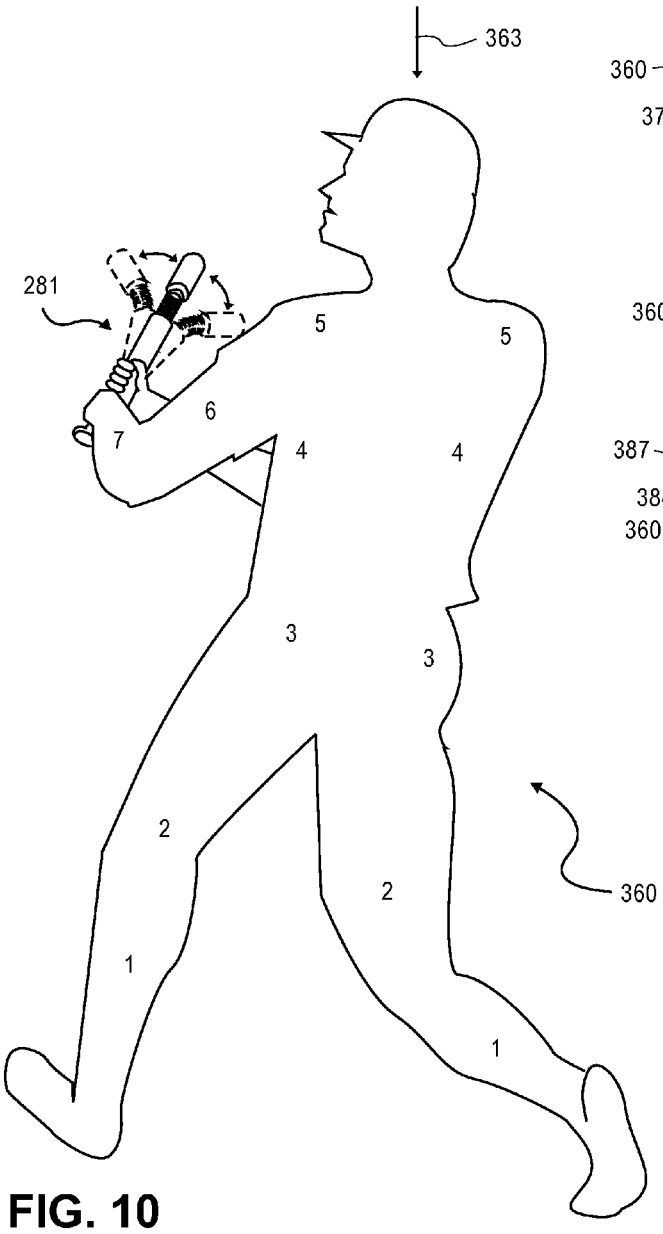
FIG. 10 is a diagrammatic perspective view of a person using a device of any of the embodiments of the present invention in accordance with a method of the present invention.

FIG. 10 is a diagrammatic perspective view of a user 360 practicing a method in accordance with the present invention. The user 360 may use a device 281 or any other embodiment as desired. The user may then stand in a batting posture as shown. The user may select a segment of the full swing that he/she desires to practice and move the bat back and forth along the swing path in the selected segment. For example, the user may select a segment corresponding to the ultimate striking position. By generating a fluid back and forth motion which maintaining a perfect strike form, the muscles, nerves, and brain all repeatedly experience the forces and responses associated with the perfect striking form. Mind muscle memory is thus built up and reinforced and the user 360 has the opportunity to strengthen the muscles for greater strength and a more powerful swing and striking force. The method may include adjusting weight magnitudes and/or positions on the device. The method may also include selecting and/or adjusting the spring stiffness of a biasing element in the device. These steps may help to establish a metronomic flex frequency. Different metronomic flex frequencies may be used to improve hitting skills and strength for a variety of different pitches including fast balls and curve balls. The method may be used to practice different strokes for different pitches and to establish or improve sweet spot hitting for different strokes of portions of a stroke in swinging a bat. The method may include practicing in a segment of a full swing for the purpose of developing a "snap" feel of a good power stroke.

As shown in FIG. 10, the method entails actuating a practice, exercise, or training device such as device 281 in a back and forth motion. During the "forth" portion of the motion certain muscles may be predominantly flexed while opposite muscles may be flexed in the "back" portion of the motion. For example, in the "forth" portion of the motion, regions 1, 2, 3, 4, 5, 6, and 7 on the right hand side of the may be actuated in sequence to produce the desired stroke. Corresponding regions on the opposite side of the body may be sequentially actuated during the "back" portion of the motion. Precisely which muscles that are actuated in these regions and to what extent may depend on the particular stance or position of the body and the stroke being implemented. However generally, the sequence will be from the feet, up through the trunk, through the arms, and to the hands. The region labeled 1 in FIG. 10 may represent the actuation of the foot, ankle, and calf. Region 2 may represent the actuation of the knee, thigh, and hamstring. Region 3 may represent actuation of the buttocks and hip. Region 4 may represent actuation of the latisimus dorsi and the trunk muscles in general. Region 5 may represent actuation of the shoulder. Region 6 may represent the actuation of the triceps and biceps muscles. Region 7 may represent the actuation of the fore arm and the wrist. A user practicing the method may feel the sequence of muscle actuation in his or her own body from region 1 through region 7 during each half stroke in the segment of the swing path being trained. Advantageously, the user may select a target on which to focus to emulate focusing during actual hitting. The resulting exercise is holistic because the back and forth motion exercises the muscles in both push and pull mode of actuation for the segment of the full swing being practiced.

The method with back and forth motions as described, also encompasses strengthening micro and macro muscle mind memory. The micro muscle and mind memory may be considered to include joint, tendon, and muscle connections and fibers, and deals with quick twitch muscle fibers. The method entrains the mind and muscle memory of a perfect stroke form through high repetitions. When combined with the macro aspects of the stroke, the method may entrain rhythm skill in muscle and mind memory. On the micro and macro levels, the method of the present invention may facilitate entraining exact timing and firing sequences for the perfect deployment of power to a specific position in space at a specific moment in time by repeating the motion over and over. With the method of the present invention, all the right muscles of the body become aligned as one to execute the strokes and repeatedly actuate in their proper sequence. The method may also include a balanced combination of power, rhythm, timing, and precision.

Figure 11A:
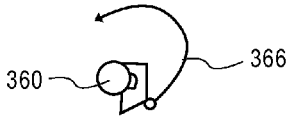
FIGS. 11A-11D are diagrammatic top plan views of a person using a device of the present invention in accordance with a method of the present invention.
Figure 11B:
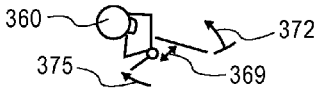
Figure 11C:
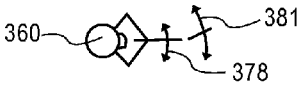
Figure 11D:
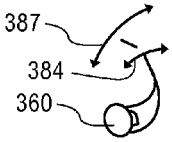

FIGS. 11A-11D are diagrammatical top views of the user taken in a direction of arrow 363 showing a swing path and back and forth motions or strokes in a variety of segments along the swing path. It is to be understood that a back and forth motion may be implemented along any segment of any swing path in accordance with the methods of the present invention. For example, FIG. 11A shows a full swing as indicated by arcuate arrow 366. FIG. 11B shows a segment from a starting position of a swing to a slightly dropped position in the early part of a swing. The small double headed arrow 369 represents the back and forth motion of the device under control of the user 360. The larger arrows 372 and 375 represent the amplified back and forth motion of a barrel piece during practice of the present method. FIG. 11C shows back and forth motions at a generally intermediate segment of the full swing. The smaller double headed arrow 378 represents the back and forth motion of the device caused by the user 360 practicing the method. The larger double headed arrow 381 represents the amplified back and forth motion of the barrel piece. Similarly, FIG. 11D shows a user 360 practicing his stroke in a segment near an end of his swing. Once again, the smaller double headed arrow 384 represents the motion imparted to a device by the user 360. The larger double headed arrow 387 represents the amplified motion of the barrel piece. Amplifying the motion of the barrel piece and associated components also amplifies the forces experienced by the user. By repeated back and forth motion, the user is required to control these amplified motions. The result is an increased sensory experience that enhances the process of building muscle and mind memory in accordance with the method of the present invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, the cables described above may be provided as any flexible filaments including elastomeric filaments that may enhance the resilience of the bending movements.

The invention claimed is:

1. A method of exercising, comprising:

providing an exercise device which includes handle and barrel pieces coupled together with a tension adjustable biasing element;

swinging the exercise device so that the tension adjustable biasing element moves the handle and barrel pieces between quiescent and flexed states;

wherein the tension adjustable biasing element biases the handle and barrel pieces in the quiescent state;

wherein the tension adjustable biasing element includes a spring coupled between the handle and barrel pieces, and an adjustment bolt which is adjustable to adjust the compression of the spring; and wherein the spring is moved between compressed and uncompressed conditions in response to the applied force.

2. The method of claim 1, further including adjusting the tension adjustable biasing element to adjust the distance between the handle and barrel pieces.

3. A method of manufacturing an exercise device, comprising:

providing barrel and handle pieces; and coupling the barrel and handle pieces together with a tension adjustable biasing element, wherein the handle and barrel pieces move between a flexed and quiescent state in response to a force applied to the tension adjustable biasing element;

wherein the tension adjustable biasing element includes a spring coupled between the handle and barrel pieces, and an adjustment bolt which is adjustable to adjust the compression of the spring; and wherein the spring is moved between compressed and uncompressed conditions in response to adjusting the adjustment bolt.

4. An exercise device, comprising:

handle and barrel pieces; and a tension adjustable biasing element which couples the barrel and handle pieces together;

wherein the handle and barrel pieces move between a flexed and quiescent state in response to a force applied to the tension adjustable biasing element, and wherein the tension adjustable biasing element is adjustable to adjust the distance between the handle and barrel pieces.

5. The device of claim 4, further including a pivot pin which extends through the handle piece.

6. The device of claim 4, wherein the cable extends through the spring.

7. The device of claim 4, wherein the tension adjustable biasing element includes first and second springs coupled between the handle and barrel pieces.

8. The device of claim 7, further including first and second flexible cables which extend through the first and second springs, respectively.

9. The device of claim 7, further including first and second adjustment bolts, wherein the first and second adjustment bolts adjust the compression of the first and second springs, respectively.

10. The device of claim 7, further including an adjustment bracket threadingly engaged to the barrel piece.

11. The device of claim 10, further including a collar threadingly engaged with the barrel piece.

* * * * *